US009950511B2

(12) United States Patent
Dodd et al.

(10) Patent No.: US 9,950,511 B2
(45) Date of Patent: Apr. 24, 2018

(54) MICROFLUIDIC ASSEMBLY AND METHODS OF FORMING SAME

(71) Applicants: STMICROELECTRONICS, INC., Coppell, TX (US); STMICROELECTRONICS (MALTA) LTD, Kirkop (MT)

(72) Inventors: Simon Dodd, West Linn, OR (US); Ivan Ellul, Zurrieq (MT); Christopher Brincat, Swieqi (MT)

(73) Assignees: STMICROELECTRONICS, INC., Coppell, TX (US); STMICROELECTRONICS (MALTA) LTD, Kirkop (MT)

( * ) Notice: Subject to any disclaimer, the term of this patent is extended or adjusted under 35 U.S.C. 154(b) by 0 days.

(21) Appl. No.: 15/277,825

(22) Filed: Sep. 27, 2016

(65) Prior Publication Data

US 2017/0232739 A1 Aug. 17, 2017

Related U.S. Application Data

(60) Provisional application No. 62/294,878, filed on Feb. 12, 2016.

(51) Int. Cl.

| | |
|---|---|
| ***B41J 2/14*** | (2006.01) |
| ***B41J 2/01*** | (2006.01) |
| *B41J 2/045* | (2006.01) |

(52) U.S. Cl.

CPC ..... *B41J 2/01* (2013.01); *B41J 2/1433* (2013.01); *B41J 2/14072* (2013.01); *B41J 2/14201* (2013.01); *B41J 2/04548* (2013.01); *B41J 2002/14362* (2013.01); *B41J 2002/14491* (2013.01)

(58) Field of Classification Search

CPC ..... B41J 2/01; B41J 2/14072; B41J 2/1433; B41J 2/04548; B41J 2002/14362; B41J 2/14201; B41J 2002/14491

See application file for complete search history.

(56) References Cited

U.S. PATENT DOCUMENTS

| | | | | |
|---|---|---|---|---|
| 2008/0158298 | A1* | 7/2008 | Serbicki | B41J 2/14072 347/50 |
| 2012/0210580 | A1* | 8/2012 | Dietl | B41J 2/17513 29/890.1 |
| 2014/0264938 | A1* | 9/2014 | Hackler, Sr. | H01L 24/50 257/774 |
| 2015/0367370 | A1 | 12/2015 | Dodd et al. | |

* cited by examiner

*Primary Examiner* — Yaovi M Ameh

(74) *Attorney, Agent, or Firm* — Seed Intellectual Property Law Group LLP

(57) ABSTRACT

One or more embodiments are directed to a microfluidic assembly that includes an interconnect substrate coupled to a microfluidic die. In one embodiment, the microfluidic die includes a ledge with a plurality of bond pads. The microfluidic assembly further includes an interconnect substrate having an end resting on the ledge proximate the bond pads. In another embodiment, the interconnect substrate abuts a side surface of the ledge or is located proximate the ledge. Conductive elements couple the microfluidic die to contacts of the interconnect substrate. Encapsulant is located over the conductive elements, the bond pads, the contacts.

14 Claims, 4 Drawing Sheets

MICROFLUIDIC ASSEMBLY AND METHODS OF FORMING SAME

BACKGROUND

Technical Field

Embodiments are directed to a microfluidic assembly and methods of forming same.

Description of the Related Art

Traditional inkjet systems, such as thermal or piezoelectric inkjet systems, typically utilize an inkjet die attached to a substrate. A flexible or rigid interconnect substrate is also attached to the substrate and electrically coupled to the die. Often a plurality of semiconductor die are mounted to a substrate and then coupled to the rigid or flexible interconnect substrate. While this process allows for precision placement of the die, electrical testing occurs after all of the dice are electrically coupled to the interconnect substrate. Thus, one of the die failing electrical test can result in the entire assembly being scrapped, thereby significantly increasing assembly time and costs.

BRIEF SUMMARY

Embodiments of the present disclosure are directed to thin film inkjet technology, such as thin film piezoelectric or thermal inkjet technology. One or more embodiments are directed to a microfluidic assembly that includes an interconnect substrate coupled to a microfluidic die. In one embodiment, the microfluidic die includes a ledge with a plurality of bond pads. The microfluidic assembly further includes an interconnect substrate having an end resting on the ledge proximate the bond pads. In another embodiment, the interconnect substrate abuts a side surface of the ledge or is located proximate the ledge. Conductive elements couple the microfluidic die to contacts of the interconnect substrate. Encapsulant is located over the conductive elements, the bond pads, the contacts.

Each assembly is able to undergo electrical testing prior to mounting a plurality of the assemblies to a substrate or printhead. Thus, in at least one embodiment, by being able to perform burn-in and electrical testing on each assembly individually, multiple assemblies do not have to be scrapped when one assembly fails testing. Furthermore, one or more embodiments allow for the microfluidic assembly to be made thinner, have a simplified assembly process, and utilize less material.

The microfluidic assembly may be used in inkjet technology in a manner as shown and described in U.S. Patent Publication No. 2015/0367370, which is hereby incorporated by reference in its entirety for all purposes. One or more embodiments of the semiconductor die described herein may have features and functions of the semiconductor die described in the above referenced application.

DETAILED DESCRIPTION

Figure 1A:
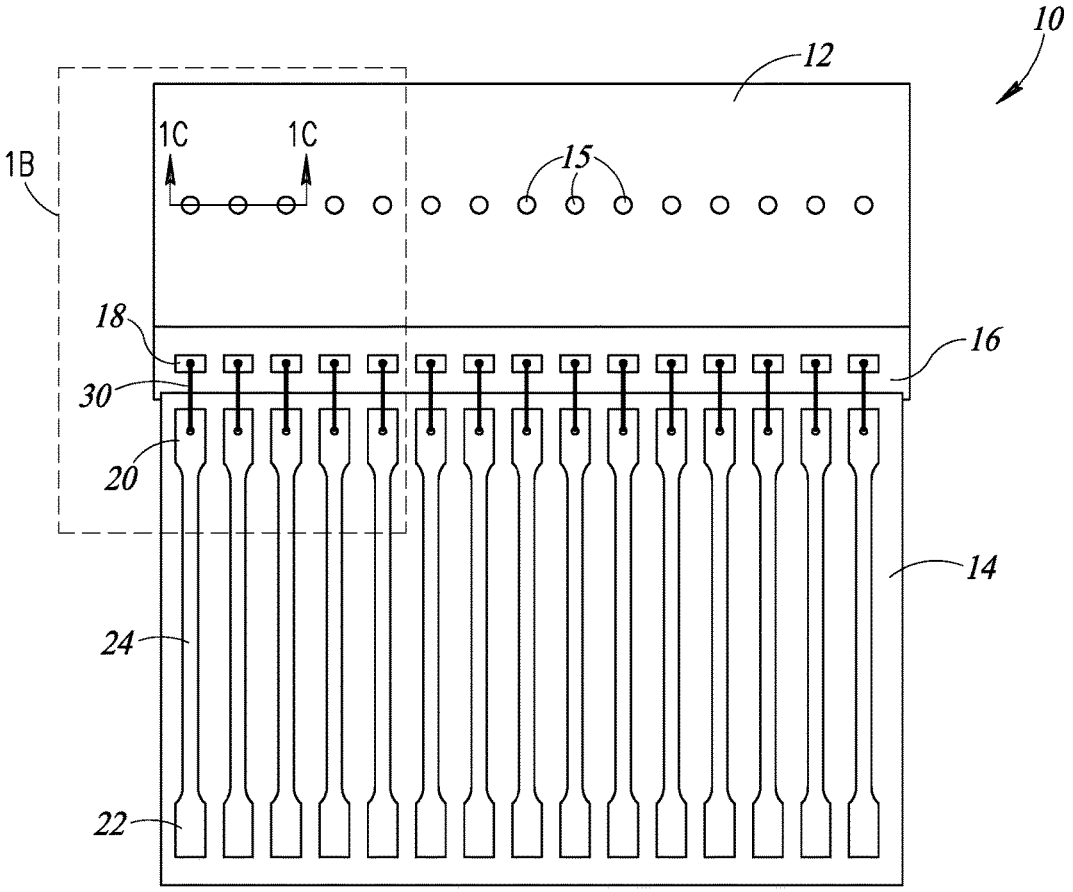
FIG. 1A is a schematic illustration of a top view of a microfluidic assembly in accordance with one embodiment.
Figure 1B:
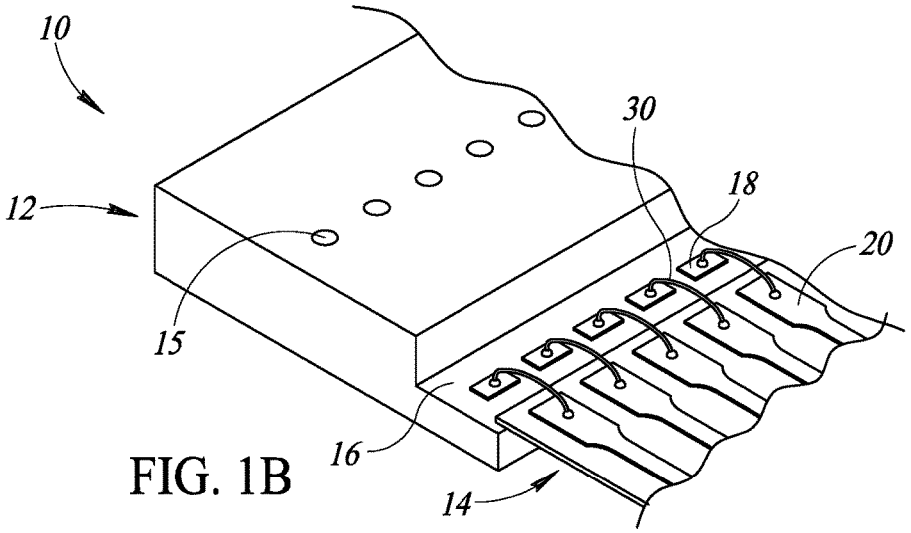
FIG. 1B is a partial close-up isometric view of the microfluidic assembly of FIG. 1A.

FIG. 1A is a top view of a schematic illustration of a microfluidic assembly 10 in accordance with one embodiment, while FIG. 1B is a partial close-up isometric view of the microfluidic assembly 10, and FIG. 2C is a partial cross-section view of the microfluidic assembly 10. Generally described, the microfluidic assembly 10 includes a microfluidic die 12 and an interconnect substrate 14 coupled to the microfluidic die at a joining region.

The microfluidic die 12 includes nozzles 15 and one or more electrical components, such as integrated circuits. In one embodiment, the microfluidic die 12 is made from a semiconductor material, such as silicon, and includes an active surface in which integrated circuits are formed. The integrated circuits may be analog or digital circuits implemented as active devices, passive devices, conductive layers, and dielectric layers formed within the microfluidic die and electrically interconnected according to the electrical design and function of the microfluidic die. For instance, the microfluidic die 12 includes integrated circuits, such as memory circuitry and nozzle drivers, formed at an active upper surface of the die. The nozzle drivers may include selection and driving transistors that drive one or more ejection elements that cause fluid to be ejected from the nozzles 15 in the microfluidic die.

In another embodiment, such as in an embodiment in which the ejection elements are piezoelectric elements, the microfluidic die may be made of a different material other than a semiconductor material, such as quartz. As will be clear to persons of ordinary skill in the art, circuitry of the microfluidic die may include top electrodes and bottom electrodes coupled to the piezoelectric elements.

The microfluidic die 12 includes a ledge 16 that extends from a side surface of the microfluidic die 12. As best shown in FIG. 1B, an upper surface of the ledge 16 extends from a side surface of the microfluidic die 12 and is offset from an upper surface of the microfluidic die 12. The ledge 16 has a back surface that is coplanar with a back surface of the microfluidic die 12 and side surfaces that are coplanar with side surfaces of the microfluidic die 12. It is to be appreciated, however, that the ledge 16 may be located in a different position relative to the side surface of the microfluidic die 12. For instance, the ledge 16 may extend from the side surface so that the upper surface of the ledge is coplanar with the upper surface (active surface) of the microfluidic die 12 and a back surface of the ledge 16 is offset from a back surface of the microfluidic die 12. Additionally, side surfaces of the ledge 16, is some embodiments, may be offset from the back and side surfaces of the microfluidic die 12.

A plurality of conductive bond pads 18 is located on the ledge 16. In the illustrated embodiment, the bond pads 18 are located in a row on the upper surface of the ledge 16. In that regard, the bond pads 18 are located along one edge or side of the microfluidic die 10. In the embodiment in which the upper surface of the ledge 16 is coplanar with the upper surface (active surface) of the microfluidic die 12 and a back surface of the ledge 16 is offset from a back surface of the microfluidic die 12, the plurality of conductive bond pads would be located on the back surface of the ledge. That is, the conductive bond pads would be facing downward in FIG. 1B, rather than upward.

Although a single row is shown, the bond pads 18 may extend in two or more rows. The bond pads 18 are coupled to the circuits of the microfluidic die 12. For instance, the bond pads 18 may be coupled to signal and power transistors that cause ejection elements, such as heater elements or piezoelectric elements, to cause fluid to expel from nozzles 15 of the microfluidic die 12. The bond pads 18 may be made of any suitable conductive materials.

The interconnect substrate 14 is coupled to the microfluidic die 12 at the ledge 16. As best shown in FIG. 1B, a first end of the interconnect substrate 14 rests on the upper surface of the ledge 16 of the microfluidic die 12. That is, a lower surface of the first end of the interconnect substrate 14 rests on the upper surface of the ledge 16 of the microfluidic die 12 proximate the bond pads 18. In one embodiment, the interconnect substrate 14 may be coupled to the upper surface of the ledge 16 of the microfluidic die 12 by an adhesive material (not shown).

The interconnect substrate 14 includes a insulative material, which in one embodiment is a polyimide layer, such as is a Kapton® polyimide film. The insulative material may be rigid or flexible. A plurality of first contacts 20 are located on the first insulative material and extend in one or more rows at the first end of the interconnect substrate. In one embodiment, the first contacts 20 are spaced apart from each other in a similar manner as the bond pads 18 on the ledge 16 so that the first contacts 20 are aligned with the bond pads 18. In another embodiment, the first contacts 20 may be in two or more rows. For instance, in one embodiment, the first contacts 20 are in two staggered rows, such that each of the first contacts 20 is substantially aligned with a respective bond pad 18.

The first contacts 20 of the interconnect substrate 14 are coupled to second contacts 22 at a second end of the interconnect substrate 14 by traces 24. The second contacts 22 are configured to electrically couple the assembly 10 to an external component or device as is well known in the art.

The second contacts 22 and the traces 24 are also located on the first insulative layer. Thus, the first and second contacts 20, 22 and the traces 24 are formed on a single plane of the first insulative layer. In that regard, various stacks and through vias within the interconnect substrate 14 are not needed, thereby simplifying the manufacturing of the interconnect substrate 14. In another embodiment, however, the interconnect substrate 14 includes through vias that, together with traces 24, which may be located on opposing sides of an insulative material, couple the second contacts 22 to the first contacts 20.

The traces 24 and the first and second contacts 20, 22 are made from one or more conductive materials. In one embodiment, traces 24 and the first and second contacts 20, 22 include a seed layer, nickel and copper. The first and second contacts 20, 22 may further include an upper gold layer. The traces 24 and first and second contacts 20, 22 may be formed by deposition and other conventional semiconductor techniques.

A second insulative layer is placed over the traces 24 and portions of the first insulative layer, while the first and second contacts 20, 22 remain exposed from the second insulative layer. The second insulative layer protects the traces from damage, such as corrosion, physical damage, moisture damage, or other causes of damage to conductive elements. The second insulative layer may be any insulative material and may include an adhesive layer, such as glue, that couples the insulating layer to the first insulative layer and the traces. The adhesive layer may, in some embodiments, be activated in response to being exposed to heat and/or ultraviolet (UV) light. In one embodiment, the second layer is a film or tape.

The bond pads 18 of the microfluidic die 12 are electrically coupled to the first contacts 20 of the interconnect substrate 14 by conductive elements 30. The conductive elements 30 may be wire bonds as shown. Alternatively, the conductive elements 30 may be tape automated bonds (TAB), conductive balls, such as solder balls, and anisotropic conductive film (ACF). As will be clear to persons of ordinary skill in the art, ACF is a conductive film that has first ends coupled to the bond pads of the die and second ends coupled to the contacts of the flexible interconnect substrate. The encouraged bonding heat, pressure, and/or ultrasonic energy may be applied to the ACF and the bond pads and contacts.

If ACF and solder balls are used, it is to be appreciated that the interconnect substrate 14 in the assembly 10 in the illustrated embodiment would be facing downward over the bond pads 18 and the ACF or solder balls would be located between the bond pads 18 and the first contacts 20. In another embodiment, a back surface of the ledge 16 of the die 12 may have the bond pads 18 and the interconnect substrate 14 is facing upwards and coupled to the bond pads 18 at the back surface of the ledge. As will be clear to persons of ordinary skill in the art, ACF involves conductive balls embedded in a polymer that, when pressure is applied, the balls break free from the polymer and make contact with the conductive elements, such as bond pads of the die and contacts of the flexible interconnect substrate, on opposing sides.

Figure 1C:
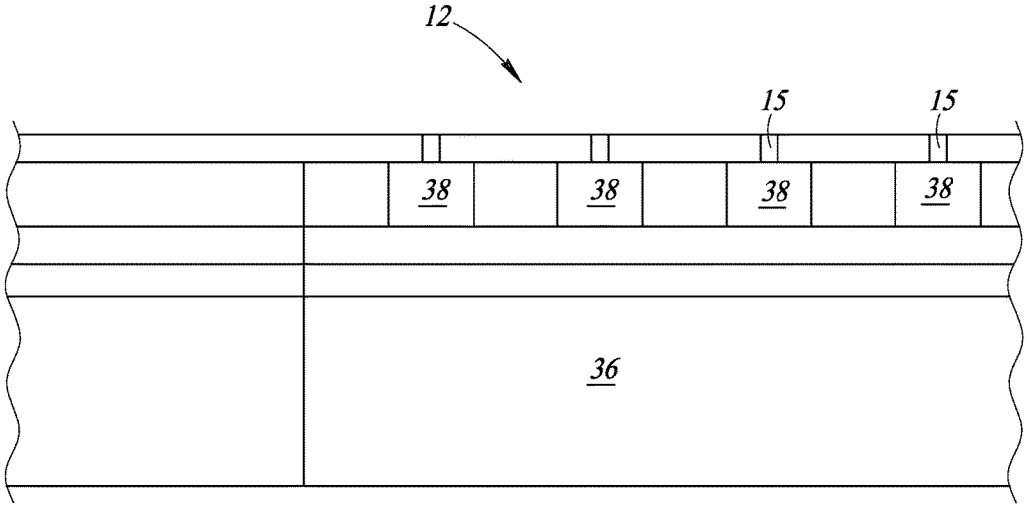
FIG. 1C is a partial cross-section view of the microfluidic die of the microfluidic assembly of FIG. 1A.

As best shown in FIG. 1C, the microfluidic die 12 includes an inlet 36 that extends to a back surface of the microfluidic die 12. The inlet 36 receives fluid from a fluid source, such as a reservoir, and provides the fluid to a plurality of chambers 38 formed in the microfluidic die 12 below the nozzles 15. The nozzles 15 are formed in a nozzle plate that covers the chambers 38. The nozzles 15 are configured to expel the fluid in the chambers 38. Although a single nozzle is located over each chamber, it is to be appreciated that a plurality of nozzles may be formed in the nozzle plate over a single chamber for expelling fluid from that chamber.

To expel the fluid through the nozzles 15, ejection elements are provided at each chamber 38, such as at a bottom surface of the chamber 38. The ejection elements are coupled to one or more of the bond pads 18, as is well known in the art.

As mentioned above, the second contacts 22 are for coupling the microfluidic assembly 10 to a separate component or device. In operation, fluid may be expelled through the nozzles 15 in response to one or more signals received by the second contacts 22 and provided to the bond pads 18, which causes the ejection elements to cause the fluid in the chamber 38 to be expelled through the nozzles 15. In the embodiment in which the ejection elements are heater elements, the heater elements heat the fluid in the chamber 38 and cause fluid therein to vaporize to create a bubble. The expansion that creates the bubble causes a droplet to form and eject from the nozzle 15. In the embodiment in which the ejection elements are piezoelectric elements, the piezoelectric elements expand and contract, which causes a membrane to flex to expel fluid through the nozzles, as is well known in the art. In the embodiment in which the ejection elements are piezoelectric elements, the microfluidic die may be made of a different material than a semiconductor material, such as quartz.

Although not shown in the embodiment, the microfluidic assembly 10 includes encapsulant (40 FIG. 2B) over exposed conductive components, such as at the ledge 16 of the microfluidic die 12 and the first side of the interconnect substrate 14. In particular, the encapsulant is located over the bond pads 18 of the microfluidic die 12, the first contacts 20 of the interconnect substrate 14, and the conductive elements 30 that couple the bond pads 18 and the first contacts 20 together.

The encapsulant is an insulative material that protects the conductive components from damage, such as corrosion, physical damage, moisture damage, or other causes of damage to electrical components. The encapsulant may be dispensed as an adhesive bead over the conductive components. Upon hardening, the encapsulant aids in bonding the interconnect substrate 14 to the ledge 16 of the microfluidic die 12. The assembly 10 is able to undergo electrical and burn-in testing.

Figure 2A:
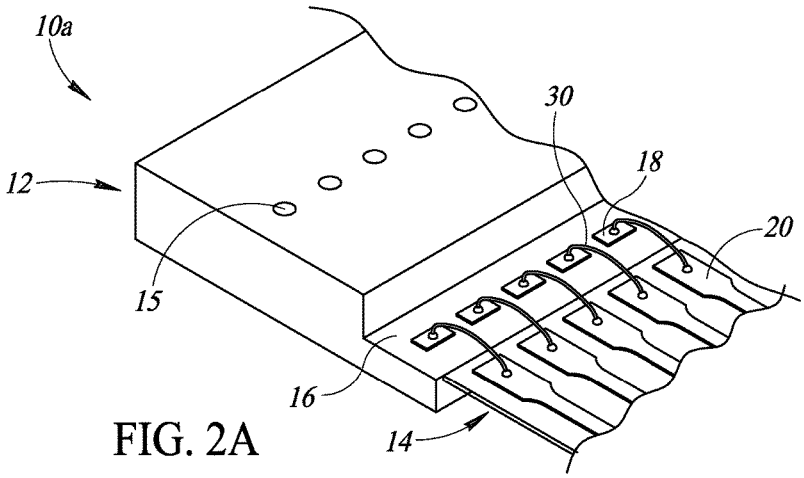
FIG. 2A is a schematic illustration of a partial isometric view of a microfluidic assembly in accordance with another embodiment.
Figure 2B:
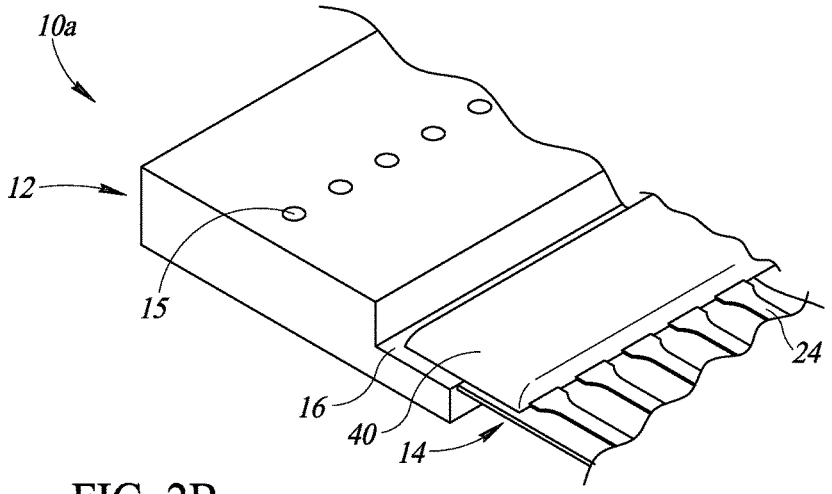
FIG. 2B is the microfluidic assembly of FIG. 2A with encapsulant.

FIGS. 2A and 2B are schematic illustrations of a microfluidic assembly 10*a* in accordance with another embodiment. The microfluidic assembly 10*a* of FIGS. 2A and 2B are the same in structure and function as the microfluidic assembly 10 of FIG. 1A except that the interconnect substrate 14 of the microfluidic assembly 10*a* of FIGS. 2A and 2B do not rest on the ledge 16 of the microfluidic die 12 but rather abuts a side surface of the ledge 16 or is proximate to the side surface of the ledge 16. In one embodiment, the upper surface of the ledge 16 is substantially coplanar with the upper surface of the interconnect substrate 14. In another embodiment, the surfaces are offset from each other.

As shown in FIG. 2B, encapsulant 40 is then placed over the bond pads 18 on the ledge 16 of the microfluidic die 12, the first contacts 20 of the interconnect substrate 14, and the conductive elements 30. The encapsulant 40, upon hardening, couples the ledge 16 of the microfluidic die 12 to the interconnect substrate 14.

In some embodiments, an adhesive or encapsulant may also be provided at the joining region at the bottom surface of the interconnect substrate 14 and the side surface of the ledge 16 to aid in securing the interconnect substrate 14 to the microfluidic die 12.

Although not shown, the interconnect substrate 14 may be further supported by a support substrate. That is, a substrate may be coupled to a bottom surface of the interconnect substrate 14 by an adhesive material. The substrate may be of any suitable material that provides structural support for at least a portion of the interconnect substrate 14.

Figure 3A:
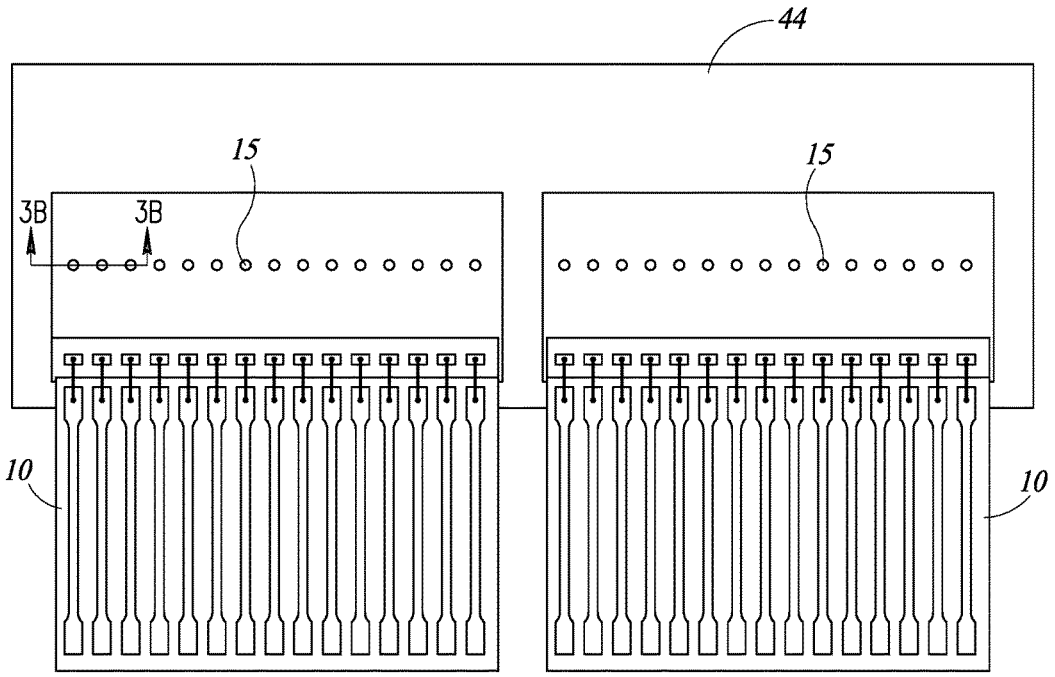
FIG. 3A is a schematic illustration of a portion of a printhead with two microfluidic assemblies of FIG. 1A mounted thereon in accordance with one embodiment.
Figure 3B:
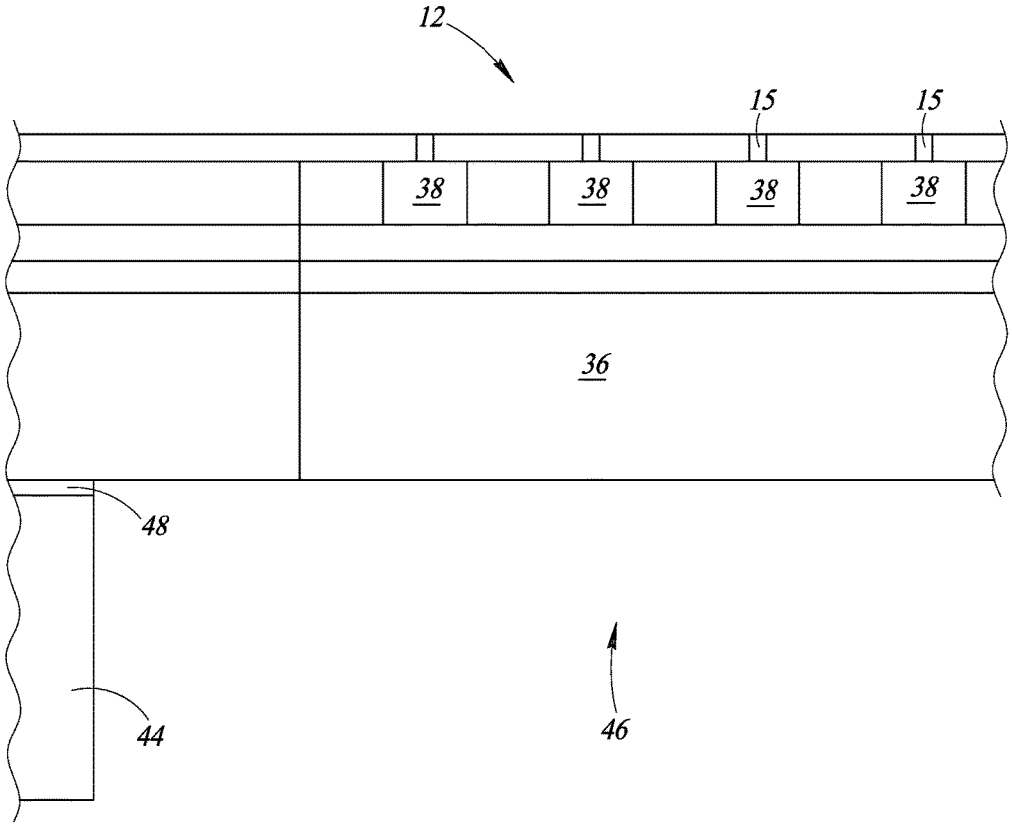
FIG. 3B is a partial cross-section view of the printhead and one of the microfluidic assemblies of FIG. 3A.

FIG. 3A is a top view of a schematic illustration of two microfluidic assemblies 10 of FIG. 1A mounted to a surface of a substrate 44, while FIG. 3B is a partial cross-section view of the one of the microfluidic assemblies 10 and the substrate 44.

In reference to FIG. 3B, the substrate 44 includes one or more through openings 46 that are aligned with the inlets of the microfluidic dice 12. In that regard, the inlets of the microfluidic dice 12 can receive fluid from a reservoir through the through openings of the substrate. The microfluidic assemblies 10 are coupled to the substrate 44 by an adhesive 48, which may be glue, which forms a seal therebetween.

The substrate 44 may be coupled to a cartridge or printhead that contains a fluid. Alternatively, the substrate is part of the printhead, such as a lid of the printhead. The printhead includes outlets (through holes) in fluid communication with the through openings 46 of the substrate 44. In that regard, the fluid in the printhead may be provided to the chambers of the microfluidic assemblies through the printhead, the through openings 46 of the substrate 44, and the inlets 36 of the microfluidic dice 12. Although two microfluidic dice are shown coupled to the substrate, it is to be appreciated that any number of microfluidic dice, including only one microfluidic die, may be coupled to the substrate.

The substrate may be any material to support the microfluidic dice. In one embodiment, the substrate is a material that has a coefficient of thermal expansion (CTE) that is between a CTE of the microfluidic die and a CTE of the printhead. In one embodiment, the printhead is made from a plastic material or a metal material and the substrate is one of graphite, ceramic, and liquid crystal polymer (LCP). Thus, by having a substrate with a CTE that is between the CTE of the microfluidic die and the CTE of the printhead, flexing in the various components due to significant difference in the CTE may be thereby reduced.

The microfluidic assembly 10 may be formed by placing the first end of the interconnect substrate 14 on the ledge 16 of the microfluidic die 12 so that the bond pads 18 of the microfluidic die 12 are aligned with the first contacts 20 of the interconnect substrate 14. In one embodiment, the microfluidic die 12 is held in place using a first holding fixture and the interconnect substrate 14 is held in place using a second holding fixture. Additionally or alternatively, adhesive is provided between the bottom surface of the first end of the interconnect substrate 14 and the upper surface of the ledge 16 of the microfluidic die 12.

Conductive elements 30 are coupled at first ends to the bond pads 18 of the microfluidic die 12 and at second ends to the interconnect substrate 14. Encapsulant 40 is dispensed over the exposed conductive components, such as the bond pads 18, the conductive elements 30, and the first contacts 20. The encapsulant 40 may be dispensed as a bead or molded onto the conductive components. As mentioned above, the encapsulant 40 both seals the electrical components and mechanically joins the interconnect substrate 14 to the microfluidic die 12. The encapsulant 40 is hardened, which may involve one or more of heat, time and UV light, to form the microfluidic assembly 10. The first and second holding fixtures may then be removed, thereby providing the microfluidic assembly 10.

For the microfluidic assembly 10*a* of FIGS. 2A and 2B, the interconnect substrate 14 is placed next to or abutting a side surface of the ledge 16 of the microfluidic die 12 so that the bond pads 18 of the microfluidic die 12 are aligned with the first contacts 20 of the interconnect substrate 14.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A printhead, comprising:

an outer surface; and a microfluidic assembly coupled to the outer surface, the microfluidic assembly including:

a microfluidic die having a first surface and a plurality of nozzles on the first surface, the plurality of nozzles being configured to expel a fluid, the microfluidic die including a ledge having a second surface that is offset from the first surface, the second surface including a plurality of bond pads;

an interconnect substrate having a first end including a plurality of contacts, the first end located on the ledge of the microfluidic die, the plurality of contacts of the interconnect substrate being laterally arranged with the bond pads of the microfluidic die;

conductive elements having first ends coupled to the bond pads of the microfluidic die and second ends coupled to the contacts of the interconnect substrate; and encapsulant material over the plurality of bond pads, the plurality of contacts, and the conductive elements.

2. The printhead of claim 1 wherein the first end of the interconnect substrate is coupled to the ledge of the microfluidic die.

3. The printhead of claim 1 wherein the encapsulant at least aids in coupling the microfluidic die to the interconnect substrate.

4. The printhead of claim 1 wherein the first surface of the microfluidic die and the second surface of the ledge are facing the same direction.

5. The printhead of claim 1, comprising a plurality of microfluidic assemblies coupled to the outer surface.

6. The printhead of claim 1, comprising a reservoir and a lid, the outer surface being an outer surface of one of the reservoir and the lid, wherein the fluid contained in the reservoir.

7. An electronic device, comprising:

an upper surface; and one or more microfluidic assemblies mounted to the upper surface, each of the one or more microfluidic assemblies including:

a microfluidic die having a plurality of nozzles to expel a fluid and a plurality of bond pads on a ledge of the microfluidic die that is offset from the plurality of nozzles;

an interconnect substrate having a first end resting on the ledge of the microfluidic die proximate the plurality of bond pads, the interconnect substrate having a plurality of contacts substantially laterally aligned with the plurality of bond pads of the microfluidic die;

conductive elements having first ends coupled to the bond pads of the microfluidic die and second ends coupled to the contacts of the interconnect substrate; and encapsulant over the plurality of bond pads, the plurality of contacts, and the conductive elements.

8. The electronic device of claim 7 wherein a first end of the interconnect substrate is coupled to the ledge of the microfluidic die.

9. The electronic device of claim 8 wherein the ledge has a surface that is recessed from a surface of the microfluidic die that includes the plurality of nozzles.

10. The electronic device of claim 9 wherein the plurality of contacts of the interconnect substrate are aligned with the plurality of bond pads on the ledge of the microfluidic die.

11. A microfluidic assembly, comprising:

a microfluidic die having a nozzle plate with a plurality of nozzles configured to expel a fluid, the microfluidic die including an ledge that extends from a side surface of the microfluidic die, the ledge having an exposed surface that is offset from an exposed surface of the nozzle plate, the ledge including a plurality of bond pads;

an interconnect substrate having an end that rests on the exposed surface of the ledge, the interconnect substrate having a plurality of contacts that are laterally aligned with the bond pads of the ledge;

conductive wires having first ends coupled to the bond pads of the microfluidic die, respectively; and second ends coupled to the contacts of the interconnect substrate, respectively; and encapsulant over the plurality of bond pads, the plurality of contacts, and the conductive wires.

12. The microfluidic assembly of claim 11 wherein the exposed surface of the ledge and the exposed surface of the nozzle plate are parallel with each other.

13. The microfluidic assembly of claim 11 wherein a first end of the interconnect substrate is on the ledge of the microfluidic die, wherein the plurality of contacts of the interconnect substrate are substantially aligned with the plurality of bond pads of the microfluidic die.

14. The microfluidic assembly of claim 11 wherein the encapsulant at least aids in coupling the interconnect substrate to the microfluidic die.

* * * * *